US005779436A

United States Patent [19]

Glezer et al.

[11] Patent Number: 5,779,436

[45] Date of Patent: Jul. 14, 1998

[54] TURBINE BLADE CLEARANCE CONTROL SYSTEM

[75] Inventors: Boris Glezer, Del Mar; Hamid Bagheri, San Diego, both of Calif.

[73] Assignee: Solar Turbines Incorporated, San Diego, Calif.

[21] Appl. No.: 693,774

[22] Filed: Aug. 7, 1996

[51] Int. Cl.[6] ..... F04D 29/38

[52] U.S. Cl. ..... 415/115

[58] Field of Search ..... 415/115, 116

[56] References Cited

U.S. PATENT DOCUMENTS

| | | | |
|---|---|---|---|
| 3,975,901 | 8/1976 | Hallinger et al. | 60/39.14 |
| 4,416,111 | 11/1983 | Lenahan et al. | 415/115 |
| 4,541,775 | 9/1985 | Hovan | 415/115 |
| 5,154,578 | 10/1992 | Miraucourt et al. | 415/173.3 |
| 5,169,287 | 12/1992 | Proctor et al. | 415/115 |

FOREIGN PATENT DOCUMENTS

| | | | |
|---|---|---|---|
| 1248198 | 9/1971 | United Kingdom | F16J 15/44 |

*Primary Examiner*—John T. Kwon

*Attorney, Agent, or Firm*—Larry G. Cain

[57] ABSTRACT

Past gas turbine engines have been manufactured with a variety of systems which have attempted to compensate for the varying radial clearance or interface between a tip of a turbine blade and a surrounding shroud. Such systems have engineered in large clearances, utilized special tips on blades and provided abradable structures. The present system controls a radial clearance or an interface or spaced distance between a tip of a blade and a stationary shroud. The system includes an introduction of a cool fluid or a hot fluid flow or a combination of cool fluid and hot fluid into a support case cavity. The flow is controlled by modulating a flow control apparatus and controlling the expansion of a nozzle support case and a stationary shroud relative to the position of the tip of the turbine blade. The system improves efficiency, longevity and operation of the gas turbine engine.

11 Claims, 4 Drawing Sheets

TURBINE BLADE CLEARANCE CONTROL SYSTEM

TECHNICAL FIELD

This invention relates generally to gas turbine engine cooling and more particularly to controlling the clearance between a rotating turbine blade and a stationary shroud.

BACKGROUND ART

High performance gas turbine engines require cooling passages and cooling flows to ensure reliability and cycle life of individual components within the engine. For example, to improve fuel economy characteristics engines are being operated at higher temperatures than the material physical property limits of which the engine components are constructed. These higher temperatures, if not compensated for, oxidize engine components and decrease component life. Cooling passages are used to direct a flow of air to such engine components to reduce the high temperature of the components and prolong component life by limiting the temperature to a level which is consistent with material properties of such components.

Conventionally, a portion of the compressed air is bled from the engine compressor section to cool these components. Thus, the amount of air bled from the compressor section is usually limited to insure that the main portion of the air remains for engine combustion to perform useful work.

Excessive clearance between a turbine rotor blade tip and a corresponding stationary shroud can cause turbine stage efficiency to be reduced, resulting in worsening turbine specific fuel consumption and power output. To minimize tip clearance, during full load operation, the turbine shroud is usually cooled. If the tip clearance is relatively small blade tip rub might occur, due to relative transient thermal displacement of stato-rotor elements.

U.S. Pat. No. 3,975,901 issued Aug. 24, 1976 to Claude Christian Hallinger and Robert Kervistin utilizes a thermally actuated, radial motion, perforated plate valve, which alternately supplies cold or hot fluid to the turbine nozzle case cavity. The system also includes a second component of cooling flow, which continuously by-passes the controlling plate valve, and is supplied to the tip shroud cavity. Due to the difficulty of positioning the plate valve, the lack of system control, and the consequences of a continuous by-pass flow, this device has a very limited capability. Additionally, the device has to be applied for each stage of a multistage turbine.

English Pat. No. 1,248,198 issued Sep. 29, 1971 to Rolls-Royce Limited has an external automatic fluid temperature control device, which provides a mixture of cold and hot fluid around the turbine tip shroud. Proportions of hot and cold fluid mixed and consequently mixture final temperature is controlled on the basis of a pressure sensed in a very small controlled clearance between the blade shroud and the stator shroud. The device can be used only for shrouded turbine blades, and results in additional coolant loss through the controlled clearance. In addition, it appears to be quite difficult to provide the small controlled clearance during both assembly and operation.

As the operating temperatures of engines are increased, to increase efficiency and power, either more cooling of critical components or better utilization of the cooling air is required.

The present invention is directed to overcome one or more of the problems as set forth above.

DISCLOSURE OF THE INVENTION

In one aspect of the present invention, a system for controlling a radial clearance between a tip of a turbine blade and a stationary shroud is comprised of a support case being positioned within a housing and forming a main cavity therebetween. The support case supports the stationary shroud and defines a support case cavity therebetween defining a heat transfer extremity. The support case has a passage defined therein communicating from the main cavity to the support case cavity. The passage has a preestablished cross-sectional area. The stationary shroud defines an inner surface defining a portion of the heat transfer extremity. The support case cavity is in communication with the support case cavity and an outer surface forms an extremity of the interface. A flow of fluid is communicated to the main cavity and is directed through the passage and is in heat transfer relationship to the heat transfer extremity of the support case cavity. A means for controlling the thermal transfer rate to one of the main cavity and the support case cavity is included and the means includes a flow control apparatus controlling the flow of fluid from one of a cool fluid flow and a hot fluid flow.

In another aspect of the invention, a gas turbine engine has an outer case, a compressor section and a turbine section operatively connected therein. The compressor section defines a flow of cooling fluid therefrom, and the turbine section has a turbine blade therein defining a tip and has a hot fluid passing therethrough being collected in an exhaust plenum after passing therethrough. A nozzle and shroud assembly is supported from the outer housing. The nozzle and shroud assembly has a stationary shroud movably positioned therein defining an inner surface and an outer surface. The outer surface is positioned radially outwardly from the turbine blade and the tip. A main cavity is formed between the nozzle shroud assembly and the outer housing. A support case cavity is formed between the stationary shroud and the nozzle and shroud assembly. A passage communicates between the main cavity and the support case cavity. And, a means for controlling the heat transfer rate of the flow to the support case cavity is comprised therein.

BEST MODE FOR CARRYING OUT THE INVENTION

Figure 1:
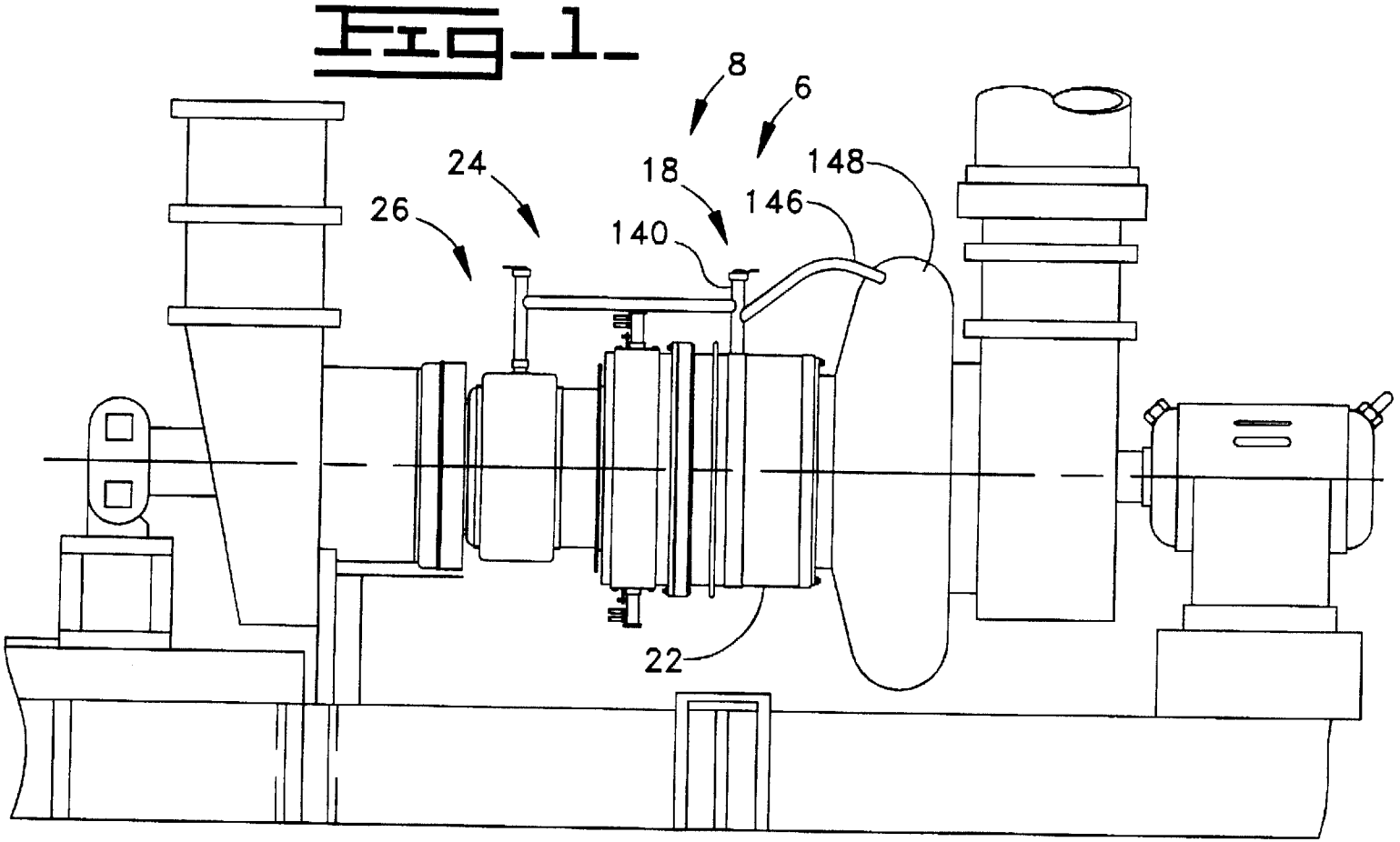
FIG. 1 is a general schematic view of a gas turbine engine embodying the present invention.
Figure 2:
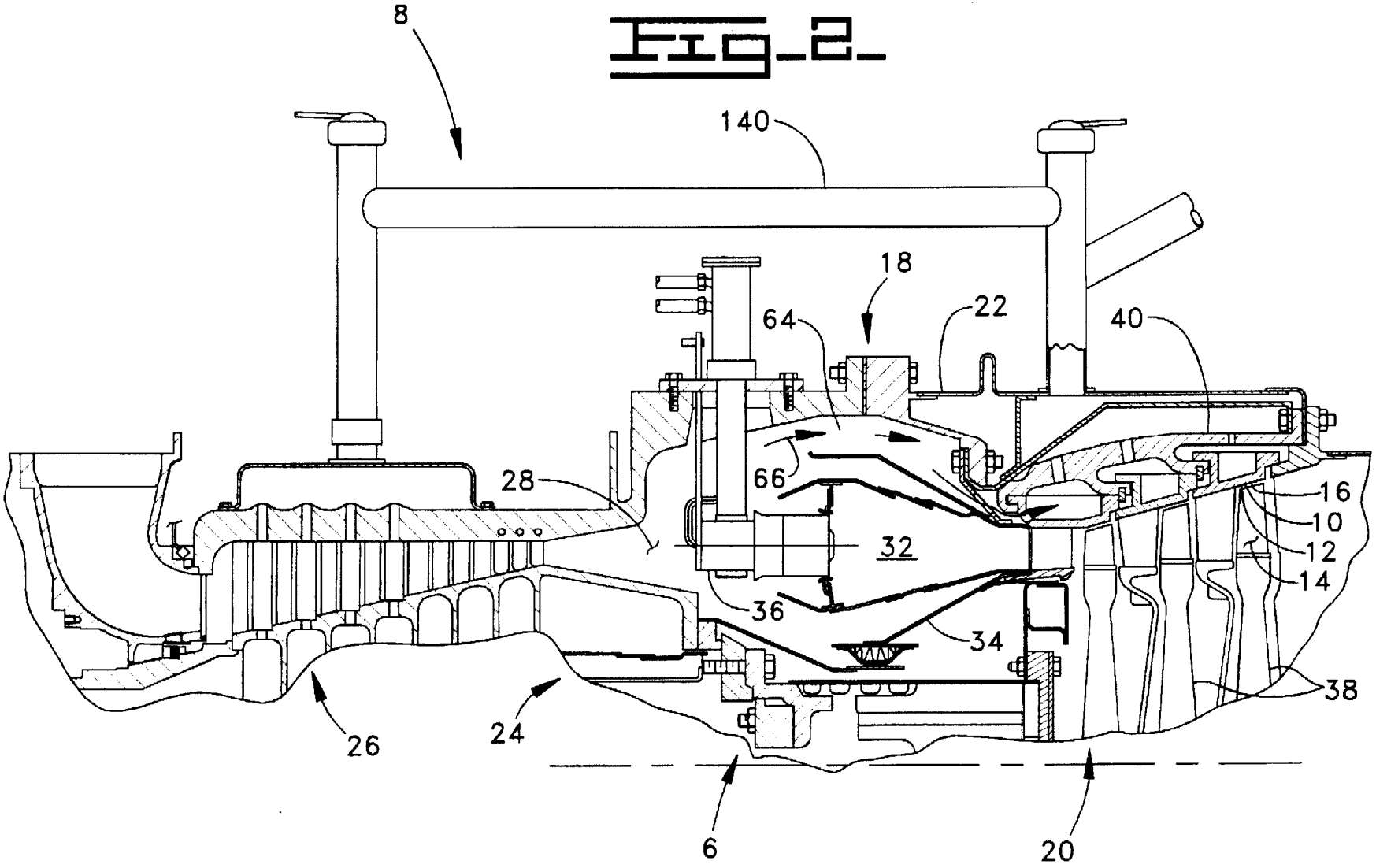
FIG. 2 is a sectional side view of a portion of a gas turbine engine embodying the present invention.

Referring to FIGS. 1 and 2, a gas turbine engine 6, shows a system 8 for controlling an interface or a radial clearance 10 between a tip 12 of a turbine blade 14 and a stationary shroud 16. The gas turbine engine 6 has been partially sectioned to further show the system 8. A cooling air delivery system 18 is shown for cooling components of a turbine section 20 of the engine 6. The engine 6 includes an outer housing 22, a combustor section 24, a compressor section 26, and a compressor discharge plenum 28 fluidly connecting the air delivery system 18 to the compressor section 26. The compressor section 26, in this application, is a multistage axial compressor. The combustor section 24 includes an annular combustion chambers 32 supported within the plenum 28 by a support 34. A plurality of fuel nozzles 36 are positioned in the combustion chamber 32. The turbine section 20 includes a plurality of turbine stages 38, such as a first stage turbine, disposed within a turbine nozzle support case 40. A nozzle and shroud assembly 40 is supported from the housing 22 in a conventional manner.

The cooling air delivery system 18, for example, has a fluid flow path 64, interconnecting the compressor discharge plenum 28 with the turbine section 20. During operation, a cooling fluid flow, designated by the arrows 66, is available in the fluid flow path 64. The flow 66 is directed from the compressor section 26 to the turbine section 20 in a conventional manner. The combustion chamber 32 is radially disposed in spaced relationship to the housing 22 and has a clearance therebetween for the flow 66 to pass therethrough.

Figure 3:
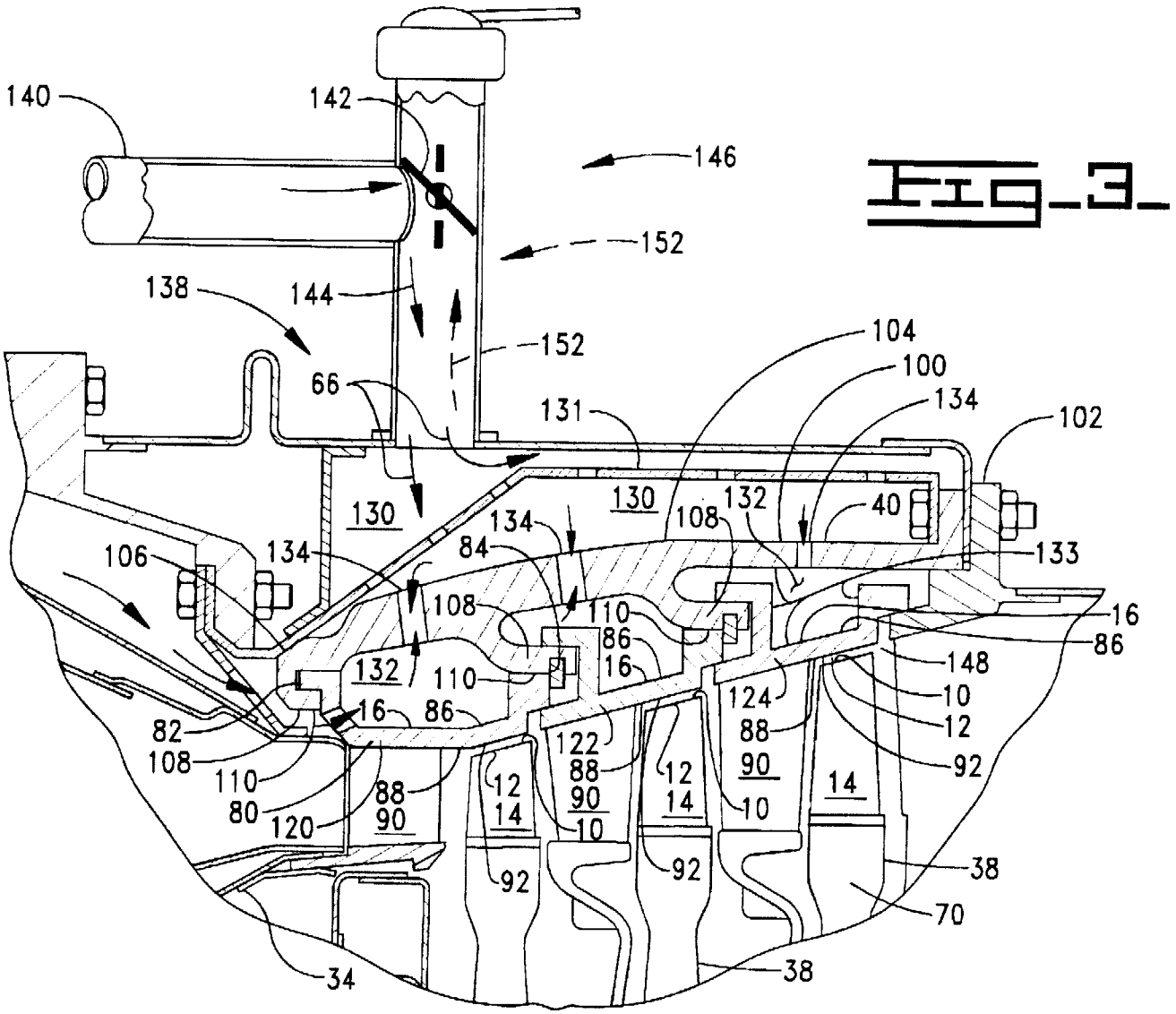
FIG. 3 is an enlarged sectional view of a portion of FIG. 2 taken along lines 3—3 of FIG. 2.

As best shown in FIGS. 2 and 3, the turbine section 20 is of a generally conventional design. For example, each of the turbine stages 38 includes a rotor assembly 70 disposed axially adjacent the nozzle and shroud assembly 40. The rotor assembly 70 is generally of conventional design and has a plurality of the turbine blades 14 defining the turbine tip 12 positioned thereon. Each of the turbine blades 14 are made of any conventional material; however, each of the plurality of blades could be made of a ceramic material without changing the essence of the invention. In this application, each of the nozzle and shroud assemblies 40 includes a plurality of the stationary shrouds 16 being integral with the nozzle or as an alternative separated therefrom and forming a shroud assembly 80. Each stationary shroud 16 defines a first end 82, a second end 84, an inner surface 86 and an outer surface 88 forming an extremity of the radial clearance 10. Extending radially inwardly from the stationary shroud 16 of the shroud assembly 40 near the first end 82 is a nozzle vane 90. Interposed the first end 82 and the second end 84 of the individual shroud assemblies 40 is a sealing surface 92 corresponding to the outer surface 88. The tip 12 of the turbine blades 14 is positioned radially inwardly of the sealing surface 92 and form respectively an inner and outer extremity of the interface or radial clearance 10 therebetween. Furthermore, in this application, each of the nozzle and shroud assemblies 40 is attached to a nozzle support case 100. For example, the nozzle support case 100 has a first end 102 attached to the outer housing 22, a body 104 and defines a cantilevered second end 106. Interposed the first end 102 and the second end 106 is a plurality of hanger members 108. Each of the plurality of hangers 108 has an end 110 radially extending inwardly from the body 104 of the support case 100.

The nozzle and shroud assemblies 40 includes a first stage nozzle and shroud assembly 120, a second stage nozzle and shroud assembly 122 and a third stage nozzle and shroud assembly 124. The first stage nozzle and shroud assembly 122 is formed by a portion of the shroud assembly 80 in which the first end 82 of the shroud assembly 80 is attached to the cantilevered second end 106 of the nozzle support case 100. And, the first end 82 of the shroud assembly 80 is attached to the end 110 of respective ones of the plurality of hangers 108 and makes up the second stage nozzle and shroud assembly 122. The second stage nozzle and shroud assembly 122 is formed by a portion of the shroud assembly 80 in which the first end 82 of the shroud assembly 80 is attached to the end 110 of the respective one of the plurality of hangers 108 and makes up the second stage nozzle and shroud assembly 122. And, the first end 82 of the shroud assembly 80 is attached to the end 110 of the one of the plurality of hangers 108 and makes up the third stage nozzle and shroud assembly 124.

A main cavity 130 is formed between the outer housing 22 and the nozzle support case 100. A perforated shield 131 is positioned in the main cavity 130 and is interposed the outer housing 22 and the nozzle support case 100. A plurality of support case cavities 132 are interposed respective first stage nozzle and shroud assembly 120, second stage nozzle and shroud assembly 122 and third stage nozzle and shroud assembly 124, and the shroud assembly 80. Each of the plurality of support case cavities 132 define a heat transfer extremity 133 being partially formed by the inner surface 86. A plurality of passages 134, having a preestablished area, communicates between the main cavity 130 and individual ones of the plurality of support case cavities 132. Each of the plurality of passages 134 could as an alternative have a different preestablished area or as a further alternative could be of a variable configuration for controlling the rate of flow 66 entering each of the plurality of support case cavities 132.

The system 8 for controlling the interface or radial clearance 10, as best shown in FIG. 3, includes a means 138 for controlling the heat transfer rate or conducting effectiveness of the flow 66. The system 8 includes a conduit 140 communicates between the compressor section 26 and the main cavity 130. And, a second conduit 141 communicates between the main cavity 130 and the exhaust plenum 148. A variable flow control apparatus such as a 2-position valve, a flapper valve or a bleed valve 142 is positioned within the conduit 140 and varies the flow 66 of a cooling fluid 144, in a cooling mode 146, between an open position (on) and a closed position (off). In this application the cooling fluid 144 is compressor discharge air. As an alternative, the system 8 could reverse the direction of the flow of fluid 66 in the support case cavity 132 and the passages 134 replacing cooling air flow with a heated air flow 150, in a heating mode 152 each shown with dotted leader lines, from a turbine gas path or exhaust plenum 154.

Figure 4:
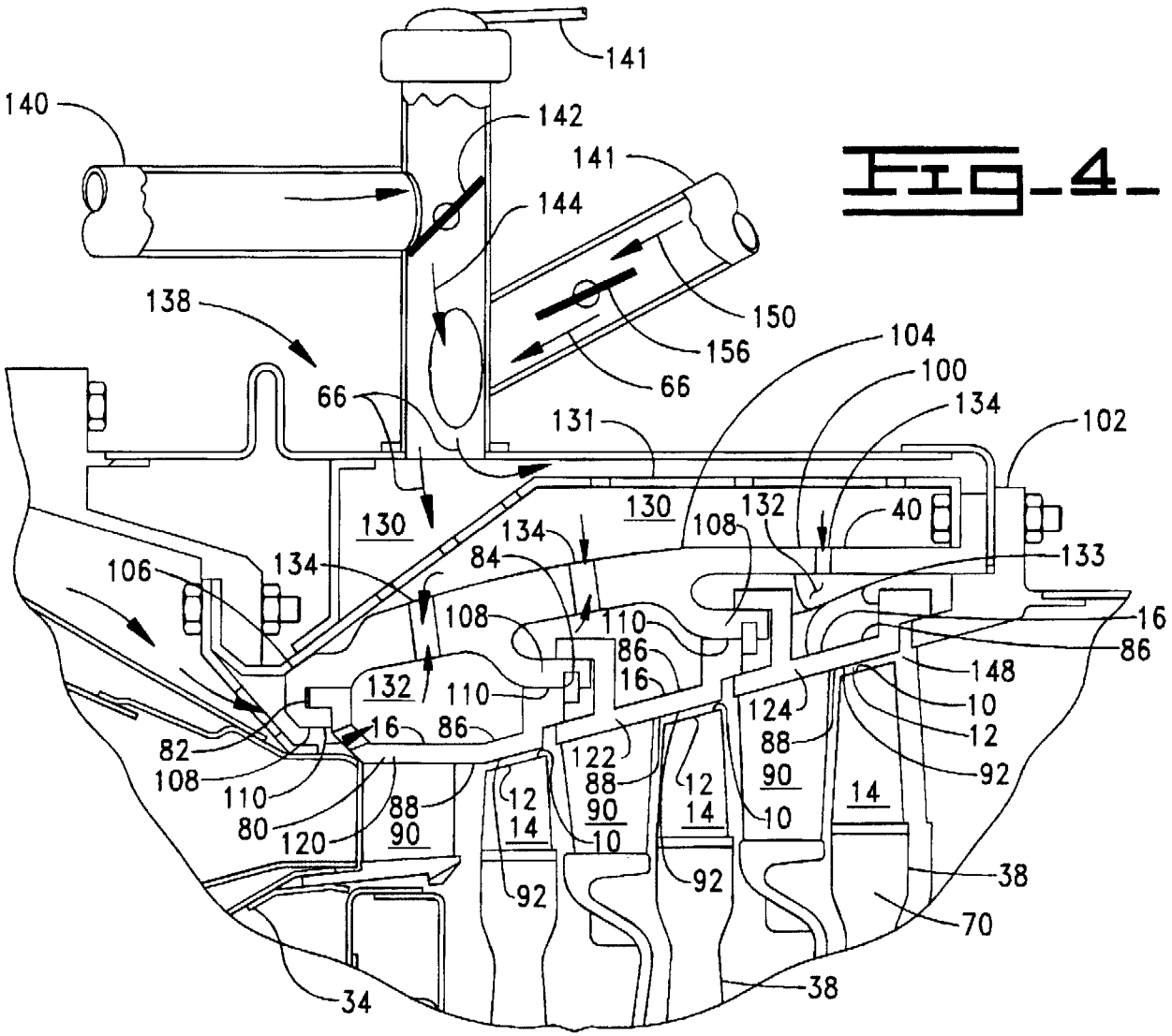
FIG. 4 is an alternative system which would be embodied in an enlarged sectional view of a portion of FIG. 2 taken along lines 3—3 of FIG. 2.

In another alternative, as best shown in FIG. 4, an additional flow control apparatus or control valve 156 could be added in a conduit 158 communication between the control valve 156 and the exhaust plenum 154. The valve 156 controls, as it is moved between a closed position and an open position, the hot fluid 150 flow 66 to the main cavity 130. Thus, the conduits 140 and the second conduit 141 can be used separately or in combination as can the valve 142 and the valve 156.

INDUSTRIAL APPLICABILITY

In operation when the engine is loaded, the controlled cool, cooling fluid 144 and the hot, heating fluid 150 are not bled and do not affect the efficiency and power of the gas turbine engine 6 while increasing the longevity of the components used within the gas turbine engine 6. During transient start or shut downs when tip clearances 10 can reach there minimum a control of thermal condition of the shroud assembly 80 is required to avoid blade tip 12 rub. Application of the system 8 to control the radial position of the nozzle support case 100 and the stationary shroud 16 with cool, cooling fluid 144 and hot, heating fluid 150 does not affect the remainder of the turbine components (blades, nozzles and disc). During normal operation a portion of the compressed air from the compressor section 26 is bled therefrom forming the flow 66 of cooling fluid 144 used to cool components of the gas turbine engine 6 and the system 8 functionally operates in the cooling mode 146. The air exits from the compressor section 26 into the conduit 140, and as the bleed valve 142 is in the closed position cooling air 144 passes through the bleed valve 142 and enters into the main cavity 130. A portion of the flow 66 of cooling air 144 is used to cool and prevent ingestion of the hot gases into the internal components of the gas turbine engine 6 and to control the physical size of the interface or radial clearance 10. For example, the cooling air 144 bled from the compressor section 26 which is directed to the main cavity 130 passes through the passage 134 and enters the support case cavity 132. Depending on the operating conditions of the gas turbine engine 6, the control valve 142 can regulate the quantity of cooling air 144 bleed from the compressor section 26 by being modulated between the closed position and the open position. Thus, the amount of cooling air 144 being directed to the individual support case cavity 132 is varied and the radial position of the individual stationary shroud 16 of the shroud assembly 80 is controlled. The result being the controlled tip clearance or interface or radial clearance 10 between the sealing surface 92 of the stationary shroud 16 making up the shroud assembly 80 of the nozzle shroud assembly 40 and the turbine tip 12 of the turbine blade 14. Thus, the controlled tip clearance 10 prevents smearing or rubbing or interference of the outer surface 88 or sealing surface 92 and the turbine tip 12 as well as controlling the space therebetween to prevent the existence of an excessive space or clearance. The excess space or clearance would reduce efficiency whereas controlling the clearance 10 maintains the efficiency and effectiveness of the gas turbine engine 6. The flow 66 through the passage 134 is controlled by predefining the preestablished cross-sectional area required to effectively conduct the fluid (cooling and heating) 144,150 into heat conducting relationship with the support case 100 and the stationary shroud 16. For example, the first stage nozzle and shroud assembly 120 will require a greater variation of flow thereto since the first stage turbine operates at a higher temperature than does the downstream turbine stages. Thus, a larger cross-sectional area is required than is the cross-sectional area of the passage 134 corresponding to the last turbine stage.

Additionally, the tip clearance 10 can be further controlled with the system 8, in the heating mode 152, by closing the coolant valve 142 and actuating the control valve 156 positioned in the second conduit 141 communicating between the main cavity 130 and the turbine gas path 148 of the gas turbine engine 6. As the control valve 156 is modulated from the open position to the closed position, the heated air flow 150 from the turbine gas path 148 is introduced into the support case cavity 132 passes through the passage 134 and enters the housing cavity 130. Depending on the operating conditions of the gas turbine engine 6, the control valve 156 regulates the quantity of hot fluid 150 bleed to the turbine gas path 148. Thus, the amount of hot fluid 150 being directed to the individual support case cavity 132 is controllably varied and the physical radial position the individual stationary shroud 16 making up the respective shroud assembly 80 is controlled. The result being the controlled tip clearance 10 between the outer surface 88 or sealing surface 92 of the shroud assembly 80 of the nozzle shroud assembly 40 and the turbine tip 12 of the turbine blade 14. Thus, the controlled tip clearance 10 prevents smearing or rubbing or interference of the sealing surface 92 and the turbine tip 12 as well as controlling the space therebetween to prevent the existence of an excessive space or clearance. The excess space or clearance required otherwise would reduce efficiency whereas the controlled clearance 10 increases efficiency and power of the gas turbine engine 6.

Increasing the flow 66 of cool, cooling fluid 144, in the cooling mode 146, to the stationary shroud 16 causes the stationary shroud 16 to radially move inwardly toward the tip 12 of the turbine blade 14 and increasing the flow 66 of hot, heating fluid 150, in the heating mode 152, causes the stationary shroud 16 to radially move outwardly away from the tip 12 of the turbine blade 14. Thus, by modulating the flow 66 of cool, cooling fluid 144 and hot, heating fluid 150 will effectively control the spacing or size of the radial clearance or interface 10.

Other aspects, objects and advantages of this invention can be obtained from a study of the drawings, the disclosure and the appended claims.

We claim:

1. A system for controlling a radial clearance between a tip of a turbine blade and a stationary shroud comprising:

a support case being positioned within a housing and forming a main cavity therebetween, said support case supporting said stationary shroud and defining a support case cavity therebetween defining a heat transfer extremity, said support case having a passage defined therein communication from said main cavity to said support case cavity, said passage having a preestablished cross-sectional area;

said stationary shroud defining an inner surface defining a portion of said heat transfer extremity of said support case cavity and being in communication with said support case cavity and an outer surface forming an extremity of said radial clearance;

a flow of hot fluid being communicated to said main cavity and being directed through said passage and being in heat transfer relationship to said heat transfer extremity of said support case cavity; and a means for controlling the thermal transfer rate of said fluid to said one of said main cavity and said support case cavity, said means including a flow control apparatus controlling the flow of hot fluid.

2. The system for controlling the radial clearance of claim 1 wherein, said hot fluid moves the outer surface of the stationary shroud a distance away from the tip of the blade.

3. The system for controlling the radial clearance of claim 1 wherein, said preestablished cross-sectional area of said passage defines the flow of fluid therethrough.

4. The system for controlling the radial clearance of claim 3 wherein, a first preestablished cross-sectional area of said passage defines a first flow of fluid.

5. The system for controlling the radial clearance of claim 4 wherein, a second preestablished cross-sectional area of said passage defines a second flow of fluid being larger than said first flow of fluid flowing through said first preestablished cross-sectional area.

6. The system for controlling the radial clearance of claim 1 wherein, said stationary shroud is movably supported within said support case.

7. A gas turbine engine having an outer housing, a compressor section and a turbine section operatively connected therein, said compressor section defining a flow of cooling fluid therefrom, and said turbine section having a turbine blade therein defining a tip and having a hot fluid passing therethrough and being collected in a turbine gas Path after passing therethrough, comprising;

a nozzle and shroud assembly being supported from said outer housing, said nozzle and shroud assembly having a stationary shroud movably Positioned therein defining an inner surface and an outer surface, said outer surface being positioned radially outwardly from said turbine blade and said tip;

a main cavity being formed between said nozzle and shroud assembly and said outer housing;

a support case cavity being formed between said stationary shroud and said nozzle and shroud assembly;

a passage communicating between said main cavity and said support case cavity;

a means for controlling the heat transfer rate of said flow to said support case cavity; and said flow of hot fluid being in heat transfer relationship with said inner surface causing said stationary shroud to radially move outwardly from said tip of said turbine blade.

8. The gas turbine engine of claim 7 wherein said means for controlling the heat transfer rate of said flow to said support case cavity includes a conduit communicating between said compressor section and said main cavity and a flow control apparatus being positioned within said conduit.

9. The gas turbine engine of claim 7 wherein said means for controlling the heat transfer rate of said flow includes a conduit communicating between said main cavity and said turbine gas path.

10. The gas turbine engine of claim 7 wherein said means for controlling the heat transfer rate of said flow to said support case cavity includes conduit communicating between the compressor section and said main cavity and a flow control apparatus being positioned within said conduit and a second conduit communicating between said main cavity and said turbine gas path and an additional flow control apparatus being positioned within said second conduit.

11. The gas turbine engine of claim 7 wherein said flow of cooling fluid being in heat transfer relationship with said inner surface causing said stationary shroud to radially move inwardly toward said tip of said turbine blade.

* * * * *